US006085539A

United States Patent [19]

Meyer

[11] Patent Number: 6,085,539

[45] Date of Patent: Jul. 11, 2000

[54] CONDENSATE DISPOSAL SYSTEM FOR AN AIR COOLED AIR CONDITIONING UNIT WITH A PROPELLER FAN

[75] Inventor: Kenneth J. Meyer, Oswego, N.Y.

[73] Assignee: Carrier Corporation, Syracuse, N.Y.

[21] Appl. No.: 09/208,796

[22] Filed: Dec. 10, 1998

[51] Int. Cl.[7] ..... F25D 21/14

[52] U.S. Cl. ..... 62/285; 62/280

[58] Field of Search ..... 62/280, 285

[56] References Cited

U.S. PATENT DOCUMENTS

| | | | |
|---|---|---|---|
| 3,724,233 | 4/1973 | Pugh et al. | 62/285 |
| 4,067,206 | 1/1978 | Smith | 62/280 |
| 4,248,057 | 2/1981 | Yaguchi | 62/280 |
| 4,382,369 | 5/1983 | Stocking | 62/280 |
| 4,538,425 | 9/1985 | Ohishi et al. | 62/280 |
| 4,631,927 | 12/1986 | Hashimoto | 62/280 |
| 5,272,886 | 12/1993 | Ukai et al. | 62/280 |
| 5,461,879 | 10/1995 | Bolton et al. | 62/280 |
| 5,697,227 | 12/1997 | Bruce et al. | 62/285 |

*Primary Examiner*—Henry Bennett
*Assistant Examiner*—Mark Shulman

[57] ABSTRACT

The base pan of a packaged terminal air conditioning system has a first condensate collecting surface under its evaporator coil and a second condensate collecting surface under its condenser coil. Fluid communication between the two surfaces is provided by a condensate flow channel, and the second condensate collecting surface is disposed at a lower vertical height than said first condensate collecting surface, such that the condensate which forms on the evaporator coil drops off and immediately flows to the second condensation collecting surface. A lifting wall is placed just upstream of a lower portion of the condenser fan and adjacent the second condensate collecting surface. The lifting wall, in cooperation with the fan creates an area of decreasing pressure above the second condensate collection surface so as to draw up the condensate into a radially inward portion of the fan where it is drawn into the fan and dispersed onto the condenser coil.

9 Claims, 5 Drawing Sheets

CONDENSATE DISPOSAL SYSTEM FOR AN AIR COOLED AIR CONDITIONING UNIT WITH A PROPELLER FAN

BACKGROUND OF THE INVENTION

This invention relates generally to air conditioning systems and, more particularly, to a condensate disposal system for a packaged terminal air conditioner.

Warm air is also frequently humid, i.e. it contains entrained water vapor. During operation of an air conditioning system in the cooling mode, the system refrigerant evaporator reduces the temperature of the air to a level below its dew point. In that condition, water vapor condenses on the evaporator. Some means must be provided to dispose of this condensate. In small unitary air conditioners, such as window or through-the-wall mounted room air conditioners, a common means to accomplish condensate disposal is by providing a condensate collection and drain path that communicates between the indoor and outdoor sections of the air conditioner. Condensate formed on the system evaporator drains into a collector in the indoor section and then flows to a location under or near the condenser fan in the outdoor section. A condensate distribution device is then provided to pick up the condensate and cause it to flow onto the hot surfaces of the system condenser where the condensate water evaporates. Such an arrangement eliminates the need for an inconvenient, unsightly and costly condensate drain from the air conditioner. Further, it provides for an economical use of the condensate in that the heat necessary to evaporate the water is taken from, and thus assists in the cooling of, the warm refrigerant in the condenser, thus resulting in an improvement in system efficiency.

Common condensate distribution schemes include vortex impellers or aspirators, slinger rings, mechanical pumps or specially designed fan blade tips. In window room air conditioners and packaged terminal air conditioners, it is most common to use a slinger arrangement associated with a condenser fan. In a typical slinger arrangement, a blow-through propeller fan coil configuration is used and the condensate collects at a location where the fan structure causes the condensate to be splashed onto the condenser coil, where it is evaporated, thereby providing cooling to the condenser.

The effectiveness of such a condensate disposal system, i.e. wherein a propeller fan is used to distribute the cold condensate generated by the indoor coil to be evaporated on the hot outdoor coil, is dependent on the following factors: (a) the distribution area of condensate onto the outdoor coil surface; (b) the temperature of that condensate spray; (c) the volume of condensate distributed to the coil and; (d) the amount of condensate that is held in the sump.

Typically the sump, where the water is collected from below the evaporator coil and flows to the condenser side for distribution, comprises a relatively large, flat pan which requires the accumulation of a considerable amount of condensate in order to rise to the level where it can be distributed onto the condenser coil. Thus, there can be standing water (i.e. as much as 1–1.5 gallons) in the sump, with no distribution taking place. Not only does this cause a delay of time until efficient operation occurs, but it also causes an undesirable condition of having stagnant water in the sump, which could cause the growth of fungus, legionnaire's disease, and the like. Further, because of the need for substantial accumulation, the temperature of the water when it finally reaches the distribution system is substantially warmer than the temperature of the condensate coming off the evaporator coil, thereby lowering the efficiency of the unit.

Generally, the condensate distribution approaches that have been used, tend to provide a relatively poor distribution of condensate across the face of the condenser coil. For example, the slinger ring tends to lift the condensate and have it blown by the fan blades into the condenser coil in a relatively small concentrated area rather than over the entire face of the condenser coil. Further, not all of the water lifted from the condensate collector is carried into the fan discharge. Some, in the form of droplets, is thrown radially outward until it impacts the system enclosure or other structural components, particularly when the fan is operating at a higher speed. Shrouds may be used to direct the droplets onto the condenser rather than on the surrounding system structures, but these structures add expense and complication.

Finally, since the full benefit of the use of the condensate to cool the condenser coil is not gained for the reasons discussed hereinabove, the condensing temperature is not lowered as much as would otherwise occur, thereby resulting in a higher evaporator temperature and less condensate being formed. The efficiency of the system is accordingly reduced.

It is therefore an object of the present invention to provide an improved condensate disposal system for an air conditioning system.

Another object of the present invention is the provision in a condensate disposal system for the improved distribution of water onto the condenser coil surface.

Yet another object of the present invention is the provision in a condensate disposal system for lowering the temperature of the water being sprayed onto the coil.

Still another object of the present invention is the provision in a condensate disposal system for increasing the volume of condensate being distributed to the coil.

Yet another object of the present invention is the provision in a condensate disposal system for reducing the amount of condensate that is held in the sump of an air conditioner.

These objects and advantages become more readily apparent on reference to the following description when taken in conjunction with the appended drawings.

SUMMARY OF THE INVENTION

Briefly, in accordance with one aspect of the invention, a packaged terminal air conditioner is provided with a condensate collecting surface below the evaporator coil and a second condensate collecting surface below the condenser coil, with the second surface being vertically lower than the first. A narrow channel is provided to interconnect the two surfaces such that all of the condensate collecting on the first surface runs off onto the second surface where it is picked up by the condensate distribution system and deposited on the condenser coil.

In accordance with another aspect of the invention, the second condensation collection surface is of minimal size, i.e. generally only large enough to contain the condenser coil, such that the volume of condensate collected and held prior to the distribution occurring is minimized.

By yet another aspect of the invention, just upstream of the condenser fan blade and adjacent the second condensate collecting surface, there is provided a lifting wall structure which extends upwardly from the condensate collecting surface and closely surrounds the lower part of the fan blade so as to create an area of decreasing pressure between the fan blade and the lifting wall so as to cause the condensate to be lifted upwardly where it can be drawn into the fan blade and distributed, relatively uniformly, over the surface of the condenser coil.

In the drawings as hereinafter described, a preferred embodiment is depicted. However, various other modifications and alternate constructions can be made thereto without departing from the true spirit and scope of the invention.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
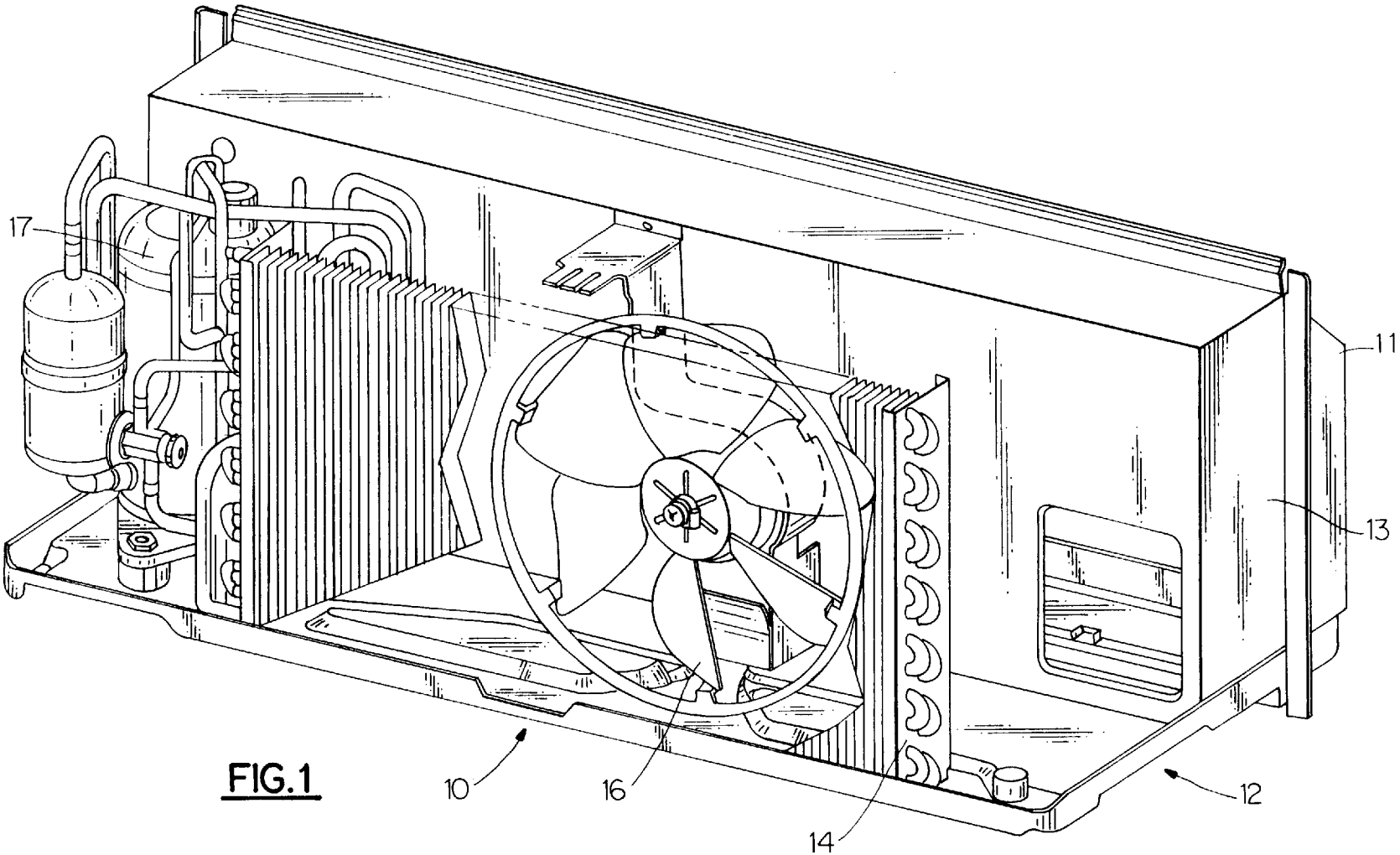
FIG. 1 is a perspective view of a packaged terminal air conditioner with the present invention incorporated therein.

Referring now to FIG. 1, there is shown a packaged terminal air conditioner with the invention shown generally at 10. The unit includes an indoor section 11, an outdoor section 12 and a transition section 13 that is located in the wall of the building. The outdoor section 12 includes a condenser coil 14 and a propeller fan 16 for circulating outside air over the condenser coil 14 for purposes of condensing the refrigerant in a conventional manner as a part of the refrigeration cycle. Within the cycle, the refrigerant is compressed by a compressor 17 and then passed through the condenser coil 14 where it is condensed. The condensed refrigerant then passes to the indoor section 12 where it is expanded into the evaporator coil prior to being returned to the compressor 17 to complete the cycle.

At the indoor section 11, there is a tendency for condensate to form on the evaporator coil, particularly in warm humid conditions. It is the purpose of the present invention to dispose of this condensate in an efficient and economical manner.

FIGS. 2–7 show various views of the base pan 18 and of the condensate pan 19. As will be seen, the base pan 18 includes raised areas 21, 22, 23 and 24. Raised areas 21 and 22 are provided for the mounting of components, such as the compressor, thereon. Raised surfaces 23 and 24 are provided as fill structures to reduce the area in which condensate accumulates in the area of the condenser coil. The adjacent grooves 25 and 30 are provided to seal between the high and low pressure areas on either side of the shroud. Also provided in base pan 18 are the vertically depressed surfaces 26, 27, 28 and 29, laterally spaced across the base pan 18. Between longitudinally spaced raised surfaces 21 and 22 is a transversely extending passageway or drainway 31 to facilitate drainage of condensate into the depressed surface 29, also referred to as a condensate collecting surface, in a manner to be more fully described hereinafter.

The condensate pan 19 which is shown in FIGS. 2–6, is installed in the outdoor section portion of the base pan 18 as shown. Drainways 32 and 33 extend transversely from one edge thereof, with the drainway 32 being aligned with, and draining into, drainway 31 of the base pan 18. Drainway 33 extends to raised area 22 as shown. The transverse profile of the condensate pan 19 is progressively lower in height as it extends across surfaces 36, 37 and 38 and finally to the drainway 32 (See FIG. 3). It will be seen while the surfaces 36, 37 and 32 are substantially flat, the surface 38 is sloping downwardly to the drainway 32. It will also be seen by reference to FIG. 6 that the surface 36 slopes downwardly as it extends longitudinally inwardly from the ends to the middle.

Figure 2:
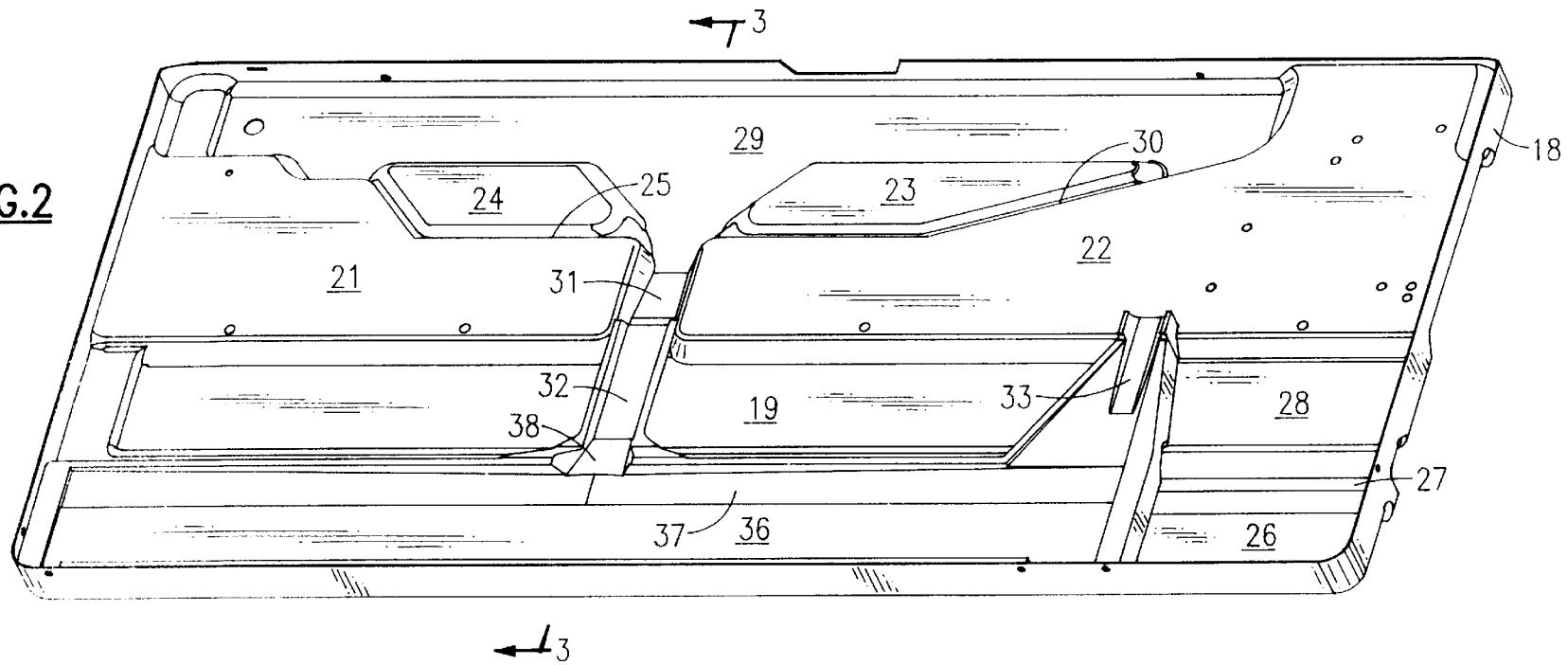
FIG. 2 is a perspective view of the base pan and condensate pan portion thereof.
Figure 3:
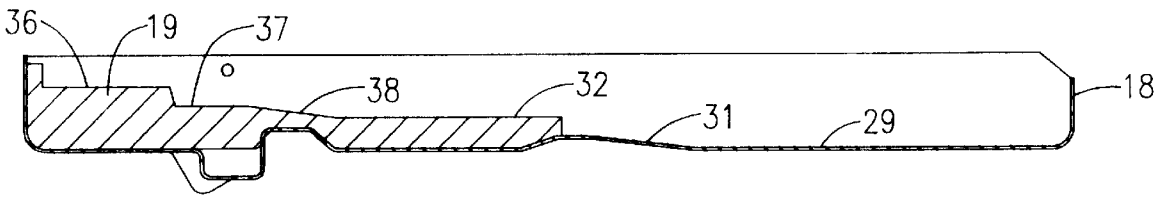
FIG. 3 is a sectional view of FIG. 2 as seen along lines 3—3 of FIG. 2.
Figure 4:
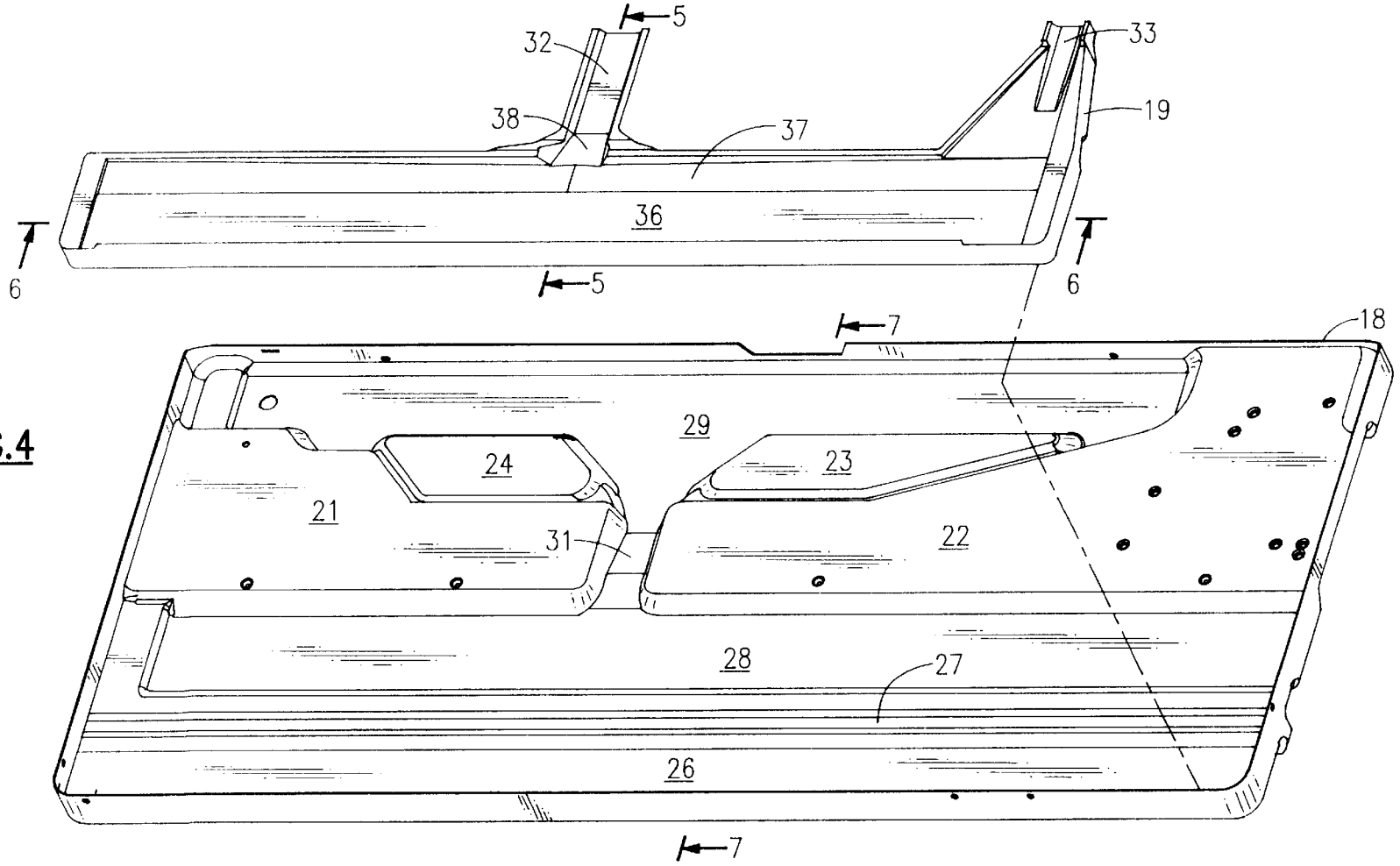
FIG. 4 is an exploded view of the base pan and condensate pan.
Figure 7:
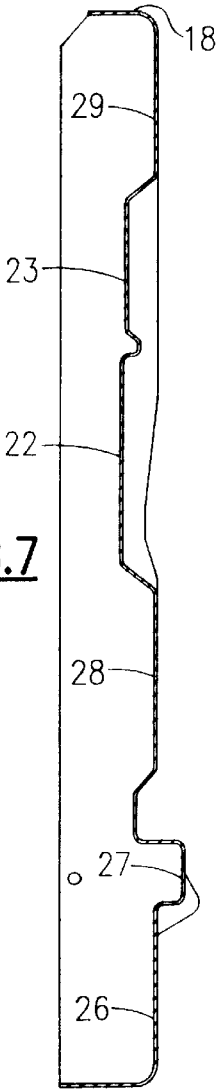
FIG. 7 a sectional view of the base pan as seen along lines 7—7 of FIG. 4.
Figure 5:
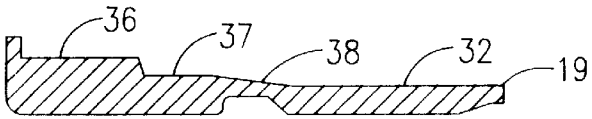
FIG. 5 is a sectional view of the condensate pan as seen along lines 5—5 of FIG. 4.
Figure 6:
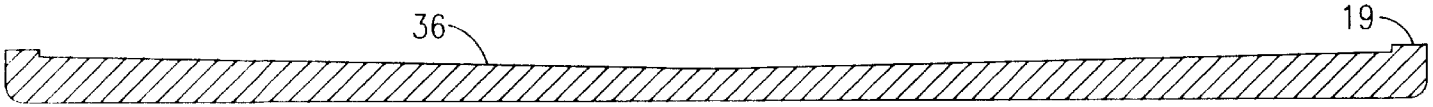
FIG. 6 is a sectional view of the condensate pan as seen along lines 6—6 of FIG. 4.

With the condensate pan 19 in place on the base pan 18, provision is made for the natural drainage of condensate from the surface 36, transversely across the surfaces 37, 38, 32 and 31 to the condensate collecting surface 29, as best shown in FIGS. 2 and 3. Thus, all of the condensate that forms on the evaporator coil, which is mounted on condensate pan surface 36, will flow, without restriction, to the condensate collecting surface 29, on which the condenser coil 14 rests. The size of the condensate collecting surface 29 is minimized (i.e. substantially the same size as the footprint of the condenser coil 14) such that the entire accumulation of condensate is available to be sprayed onto the condenser coil in a manner to be described hereinafter. Further, because of the sloping profile as described hereinabove, none of the condensate is stored at any other surface. Rather, it flows directly to the condensate collecting surface 29 where it is applied with very little accumulation.

The drainway 33 is sloped in the opposite direction from that of the surface 38 such that the condensate that forms on the tubing which passes between the outdoor and indoor sections, tends to flow off the tube, down the drainway 33, to the surface 37, and eventually to the condensate collection surface 29.

Figure 8:
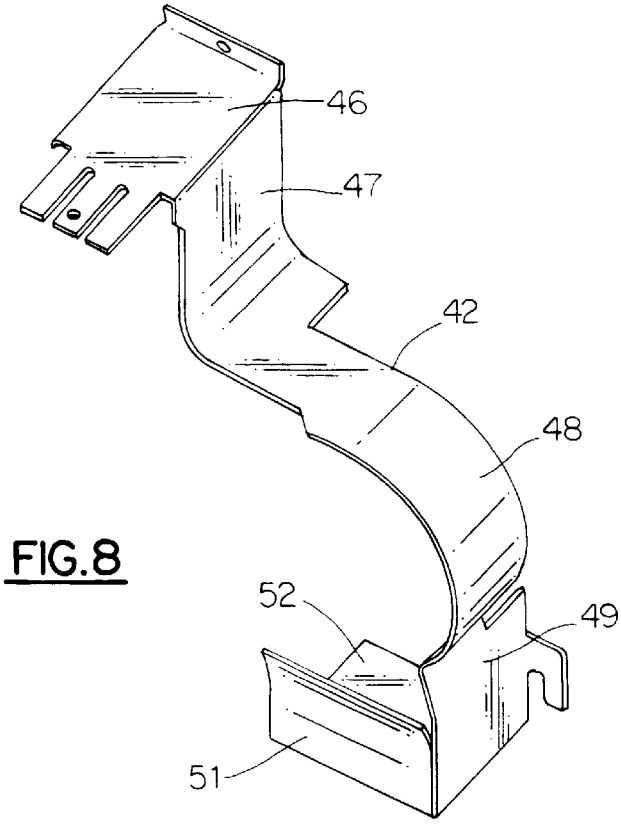
FIG. 8 is a perspective view of the gusset assembly thereof.
Figure 9:
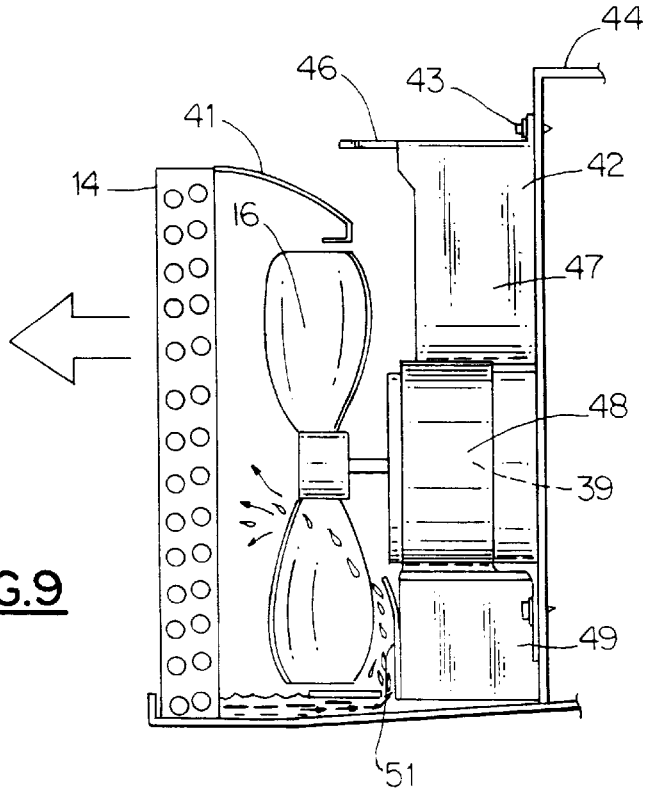
FIG. 9 is a side view thereof showing the lifting wall portion of the gusset assembly operation.

Referring now to FIGS. 8 and 9, the structure which facilitates the distribution of the condensate on to the condenser coil 14 will now be described. As will be seen in FIG. 9, the propeller fan 16 is driven by the motor 39 and is disposed adjacent the condenser coil 14. A shroud 41 closely surrounds the fan 16 in a well known manner. The fan 16 may have a slinger-ring as shown in FIG. 1, or it may have no ring as shown in FIG. 9. Located on the upstream side of the fan 16 is a gusset 42 which is mounted by way of fasteners 43 to a frame 44.

The gusset, as shown in full in FIG. 8, includes top member 46, upper air flow baffle member 47, snow shield member 48, lower air flow baffle member 49, water spray wall 51, and a condensate trough cover 52. The gusset 42 is so located that the snow shield member 48 wraps around, but does not directly contact the motor 48, and the water spray wall 51 is located just upstream of the fan 16 at the lower portion thereof as shown in FIG. 9. The functions of the various sections of the gusset 42 will not be described.

High speed rotational fans tend to develop swirling intake air, which in turn degrades performance. On side intake models of air conditioners, it is therefore desirable to have rotation stopping baffles on the top and bottom intakes. The upper and lower air flow baffle members 47 and 49 are therefore provided to perform this function.

Because of the outdoor section being exposed to the weather, blowing snow can be caused to fall onto the hot motor 48. When the resulting melted snow drips onto the cold base pan it can create an ice ball which can then interfere with the movement of the fan 16. The snow shield member 48 thus serves to prevent this occurrence by shielding the motor from direct contact with the snow.

The water spray wall 51 is strategically located with respect to the fan 16 such that the pressure between the fan 16 and the wall 51 is progressively lower in the radially inward direction. This is caused by the vortex effect which occurs because of faster moving air having less pressure than still air. The effect is that the condensate in the condensate collecting surface 29 of the base pan 18 is cause to be "sucked up" into the radially inner portion of the fan 16 so as to be more evenly distributed across the condenser coil 14 than would otherwise occur if the condensate were contacted only by the radially outer portions of the fan 16. For best performance, the water spray wall 51 should be placed as closely as possible to the fan 16 and should approximate as closely as possible the same shape in the vertical plane.

The condensate trough cover 52 at the lower end of the gusset 42 is provided to cover the drainway 31 leading to the condensate collecting surface 29 so as to thereby prevent the entry of outside contaminates such as leaves and dirt.

While this invention has been explained with reference to the structure disclosed herein, it is not confined to the particular details as set forth, and this application is intended to cover any modifications and changes as may come within the scope of the following claims.

What is claimed is:

1. A condensate disposal system for an air conditioner of the type having an evaporator section and a condenser section, the evaporator section having a coil on which condensate tends to form and a condenser section having a condenser coil and a propeller fan that blows cooling air thereover, comprising:

a first condensate collecting surface disposed below the evaporator coil for receiving the condensate that collects on and drips from the evaporator coil;

a second condensate collecting surface disposed below the condenser coil and being at a lower elevation from and fluidly connected to said first condensate collecting surface by way of a channel;

a condensate distribution means for distributing the condensate from said second condensate collecting surface to a side of the condensate coil and a wall disposed adjacent to and upwardly from said second condensate collecting surface and adjacent the trailing edge of the fan so as to create a negative pressure at the radially inward portion of that space defined between the wall and the fan to thereby draw up the condensate from said second condensate collecting surface.

2. A condensate disposal system as set forth in claim 1 wherein said second condensate collecting surface is substantially the same size as a lower surface of the condenser coil.

3. A condensate disposal system as set forth in claim 1 wherein said channel is centrally located so as to be substantially aligned with the axis of the fan.

4. A condensate distribution system for an air conditioner of the type having an evaporator coil on which condensate tends to form, a condenser coil and associated fan, and at least one condensate collecting surface for collecting the condensate from off the evaporator coil and causing it to flow to a position below the fan, comprising:

a lifting wall disposed on and in close proximity to an upstream side of a radially outward portion of the fan, adjacent the condensate collecting surface, said lifting wall being curved toward the fan as it extends radially inwardly so as to create between the fan and the wall a zone of decreasing pressure from a radially outward portion to a radially inward portion, thereby causing the condensate in the collector pan to be drawn to a radially inward portion of the fan where it is then distributed across a face of the condenser coil.

5. A condensate distribution system as set forth in claim 4 wherein said condensate collecting surface includes an intermediate channel which is substantially aligned with the axis of the fan.

6. A condensate distribution system as set forth in claim 4 wherein said lifting wall is planer in form with a curve which approximates the trailing edge of the fan.

7. A condensate distribution system as set forth in claim 4 wherein said at least one condensate collecting surface has a first surface below said evaporator coil and a second surface below said condenser coil, said second surface being at a lower vertical height than said first surface.

8. A condensate distribution system as set forth in claim 4 wherein said lifting wall is part of a gusset member which is secured to and supported by a frame member.

9. A condensate distribution system as set forth in claim 8 wherein said gusset member includes a snow shield portion that wraps around a drive motor for the fan.

* * * * *